United States Patent [19]

Jernigan

[11] 4,165,067

[45] Aug. 21, 1979

[54] APPARATUS FOR MAKING SUBSTANTIALLY IMPENETRABLE MEMBERS

[76] Inventor: Emory J. Jernigan, P.O. Box 254, Chester, Va. 23831

[21] Appl. No.: 858,342

[22] Filed: Dec. 7, 1977

Related U.S. Application Data

[62] Division of Ser. No. 709,271, Jul. 28, 1976, Pat. No. 4,079,497.

[51] Int. Cl.[2] ..... B25B 1/20

[52] U.S. Cl. ..... 269/40; 29/281.1; 269/296; 269/306

[58] Field of Search ..... 29/281.1, 241; 269/10, 269/43, 37, 46, 296, 303, 40, 306, 319

[56] References Cited

U.S. PATENT DOCUMENTS

| | | | |
|---|---|---|---|
| 1,396,162 | 11/1921 | Campbell et al. | 269/40 X |
| 2,226,440 | 12/1940 | Parker | 269/319 X |
| 2,236,876 | 4/1941 | Jablon | 29/241 X |
| 2,664,842 | 1/1954 | Larmor | 269/40 X |
| 3,067,994 | 12/1962 | Ronbeck | 29/241 X |
| 3,233,316 | 2/1966 | Lynn | 29/241 |
| 3,568,289 | 3/1971 | Jenkins et al. | 269/296 X |
| 3,781,003 | 12/1973 | DeAngellis | 269/40 |
| 3,834,349 | 9/1974 | Dietze | 269/296 X |

*Primary Examiner*—Charlie T. Moon
*Attorney, Agent, or Firm*—Richard P. Matthews

[57] ABSTRACT

Apparatus for making substantially impenetrable members such as wall and floor members for bank vaults or the like. A fixture is used which facilitates the assembly of a plurality of expanded sheet metal members in a spaced stack thereof. Rod members are inserted transversely of the expanded sheet metal members with at least some of the rods extending beyond the sides of the spaced stack of expanded sheet metal members. The fixture is elevated at one end so that the rod members may be secured to the expanded sheet metal members simultaneously in a number of different positions. An auxiliary frame member may be employed whenever it is necessary to align the sheets vertically prior to being secured to the rod members.

11 Claims, 11 Drawing Figures

APPARATUS FOR MAKING SUBSTANTIALLY IMPENETRABLE MEMBERS

This patent application is a division of Ser. No. 709,271, filed July 28, 1976, now U.S. Pat. No. 4,079,497 issued Mar. 28, 1978.

This invention relates to an apparatus for making substantially impenetrable members such as wall and floor members for bank vaults or the like.

Heretofore it has been the custom to make substantially impenetrable member such as wall and floor members by placing individual sheets of expanded metal members in place one sheet at a time at the job site with the aid of a flexible perforated strap member to retain the sheets in place until concrete could be poured over the assembled sheets. The progression and development of the wall or floor member was necessarily slow and tedious by this mode of assembly and, consequently, quite costly.

In accordance with the present invention, cores suitable for use in making wall or floor members may be prepared in advance and taken to the job site for assembly in a fraction of the time and cost. A fixture is provided which facilitates the alignment of a plurality of sheets of expanded metal whereby these cores may be assembled into a composite core and a wall or floor poured in an extremely short period of time. The fixture may be of any convenient width, for example, one which will hold fifty sheets at a time. The fixture is preferably elevated at one end whereby rod members may be inserted transversely through the apertures of the expanded metal and secured thereto, such as by tying, in a plurality of different locations simultaneously. The rods extend beyond the sides of the stacked expanded sheet metal members whereby one core may readily by anchored to an adjacent core by tying the rod members together. An auxiliary frame member is used in combination with the fixture member whenever it is necessary to align the sheets prior to pouring the concrete as in making a flat deck member. After the expanded metal sheets have been assembled in a stack and secured to the rod members the assembled stack is removed from the fixture by any suitable means such as by a block and tackle arrangement. The fixture may then be used again to assemble another core member.

In addition to making wall and floor members for bank vaults, the present invention is applicable to the manufacture of nuclear reactors where curved expanded metal members may be employed, in making vacuum test chambers, army fortifications, tank barriers, bridge decks, means to contain an explosion, and similar uses where substantial impenetrability is desired.

The apparatus of the present invention is utilized in the following manner:

(a) The fixture is provided with a plurality of sets of lateral spacing members for a plurality of expanded metal sheet members;

(b) A plurality of expanded metal sheet members are inserted between the lateral spacing members on the fixture to establish a spaced stack thereof;

(c) Rod members are inserted through openings provided by the expanded metal sheet members with at least some of the rod members extending beyond the sides of the stacked expanded metal sheet members;

(d) The rod members are secured to the expanded metal sheet members;

(e) and the stacked expanded metal sheet members are removed with rod members secured thereto from the fixture to serve as a core member for use in making a substantially impenetrable member.

Thereafter, and depending upon the particular structure being built, a plurality of core members produced in the above manner may be assembled in juxtaposed relation and the rod members from adjacent core members secured together to establish a composite core member. Thereafter, concrete is poured over the composite core member to establish a substantially impenetrable member.

The inherent advantages and improvements of the present invention will become more readily apparent by reference to the detailed description of the invention and by reference to the accompanying drawings in which.

Figure 1:
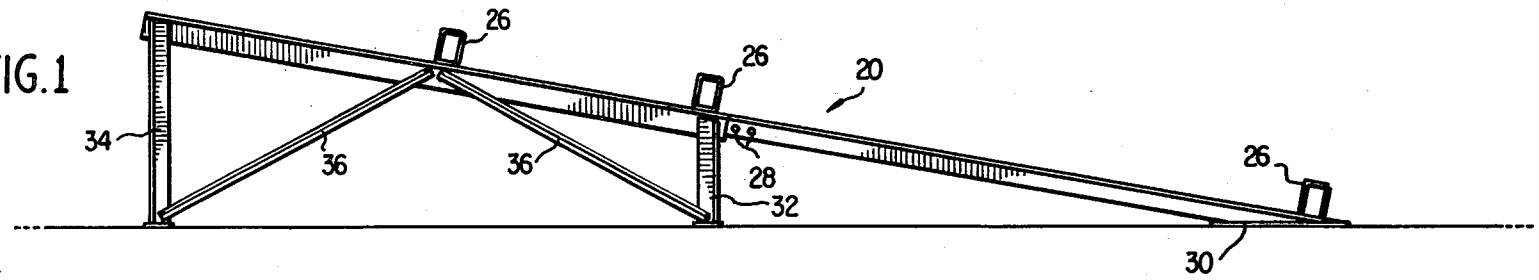
FIG. 1 is a side elevational view of a fixture used in accordance with the present invention to obtain alignment of a plurality of expanded metal members.
Figure 2:
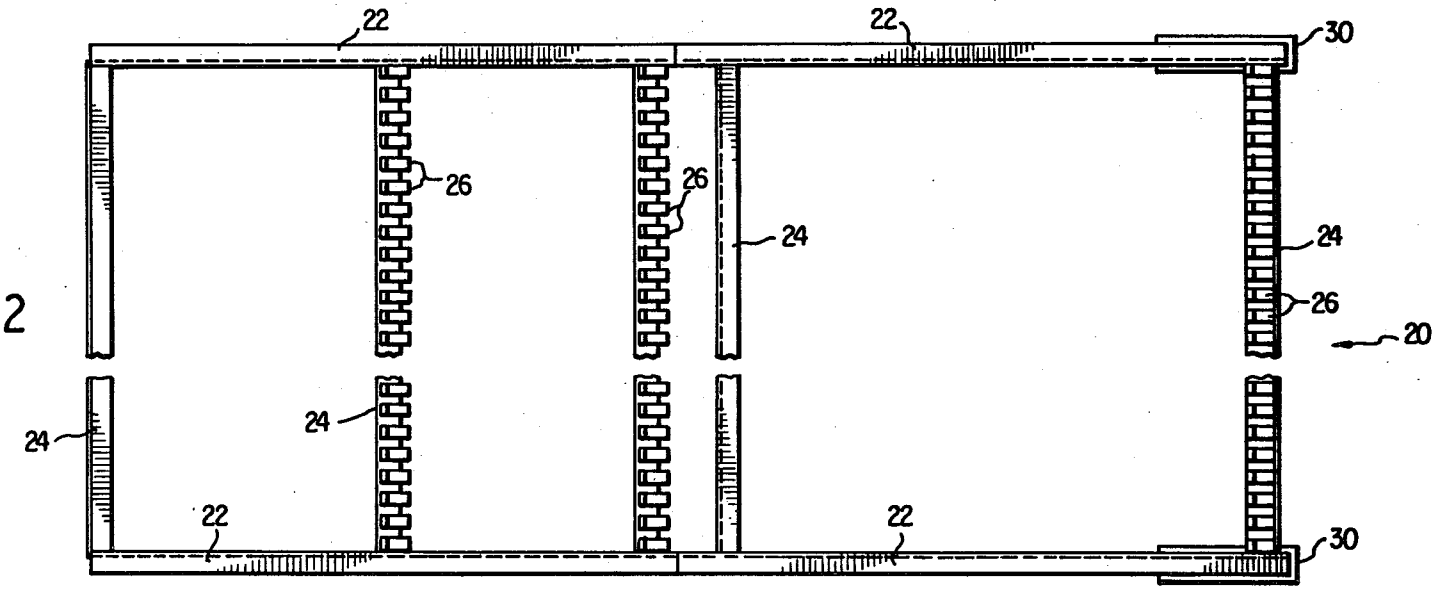
FIG. 2 is a fragmentary top plan view of the fixture of FIG. 1.

Referring now to FIGS. 1 and 2 of the drawings, a fixture for use in assembling a substantially impenetrable wall or floor member is indicated generally at 20 having longitudinally extending frame members 22 and laterally extending frame members 24. In order to provide lateral spacing for a plurality of expanded metal sheet members, the fixture 20 is provided with a plurality of sets of lateral spacing members 26. These lateral spacing members 26 may be formed from a plurality of angles welded to each other and to a lateral frame member 24 or, alternatively, by cutting a tubular member or the like into discrete sections and attaching them to the laterally extending frame members 24. The spacing between each of the lateral spacing members 26 is of a size to accommodate a single expanded metal sheet member such as is shown at 40 in FIG. 3.

In a preferred embodiment, the longitudinally extending frame members 22 are provided with an overlapping section which is folded together at 28 whereby the frame may be assembled and disassembled at will and transported over the road from one job site to another. As seen in elevation in FIG. 1, the fixture 20 has a ground-engaging flat plate member 30 at one end, intermediate legs 32 at substantially the mid section of the fixture and end legs 34. End legs 34 are greater in height than legs 32 whereby it is possible with the elevation of one end of the fixture 20 to get under the fixture in order to secure the expanded metal sheet members 40 to the frame as will be explained hereinafter. Suitable bracing members are shown at 36 for portions of the fixture 20.

Figure 3:
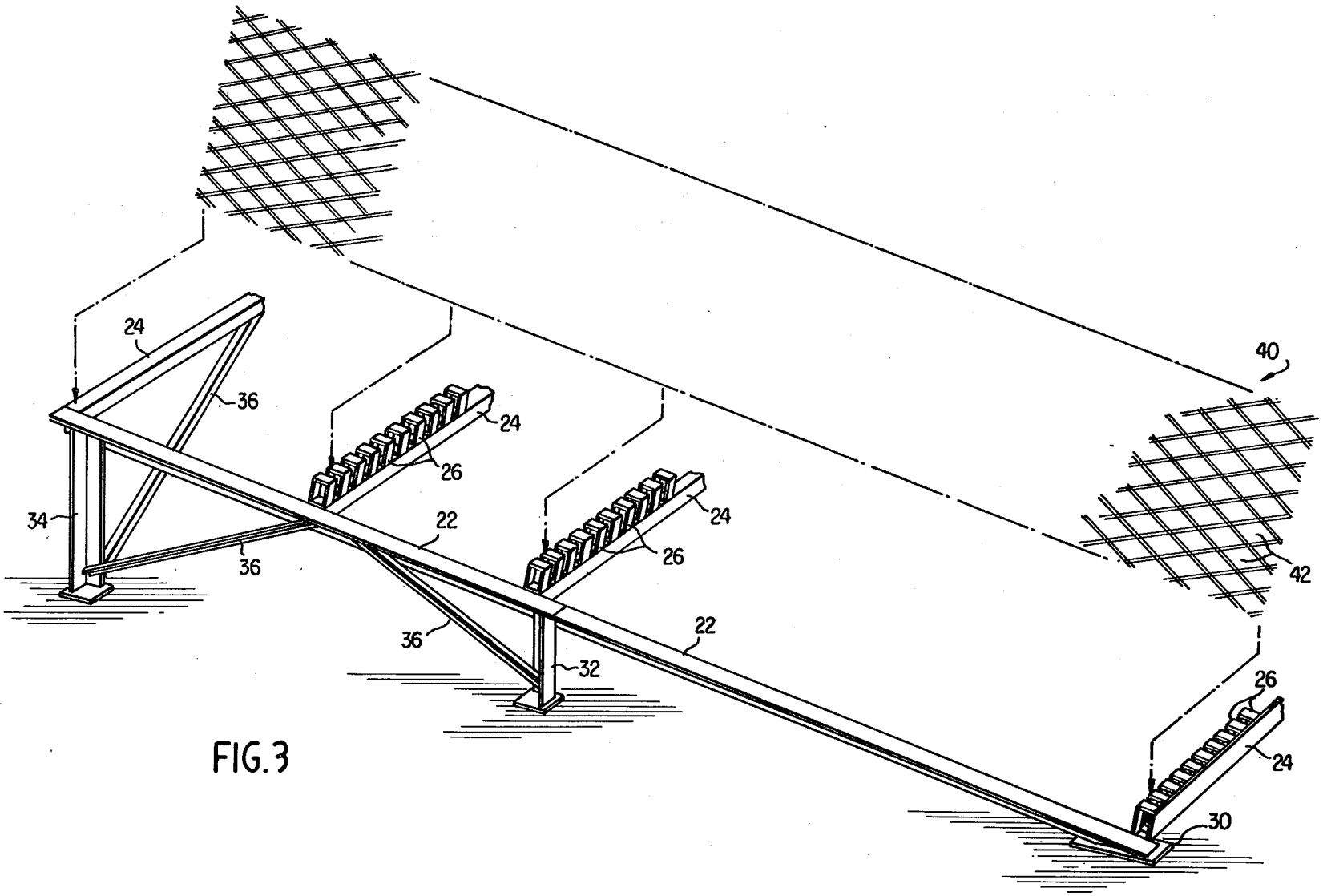
FIG. 3 is a fragmentary perspective view illustrating the insertion of expanded metal members into the fixture of FIG. 1.
Figure 4:
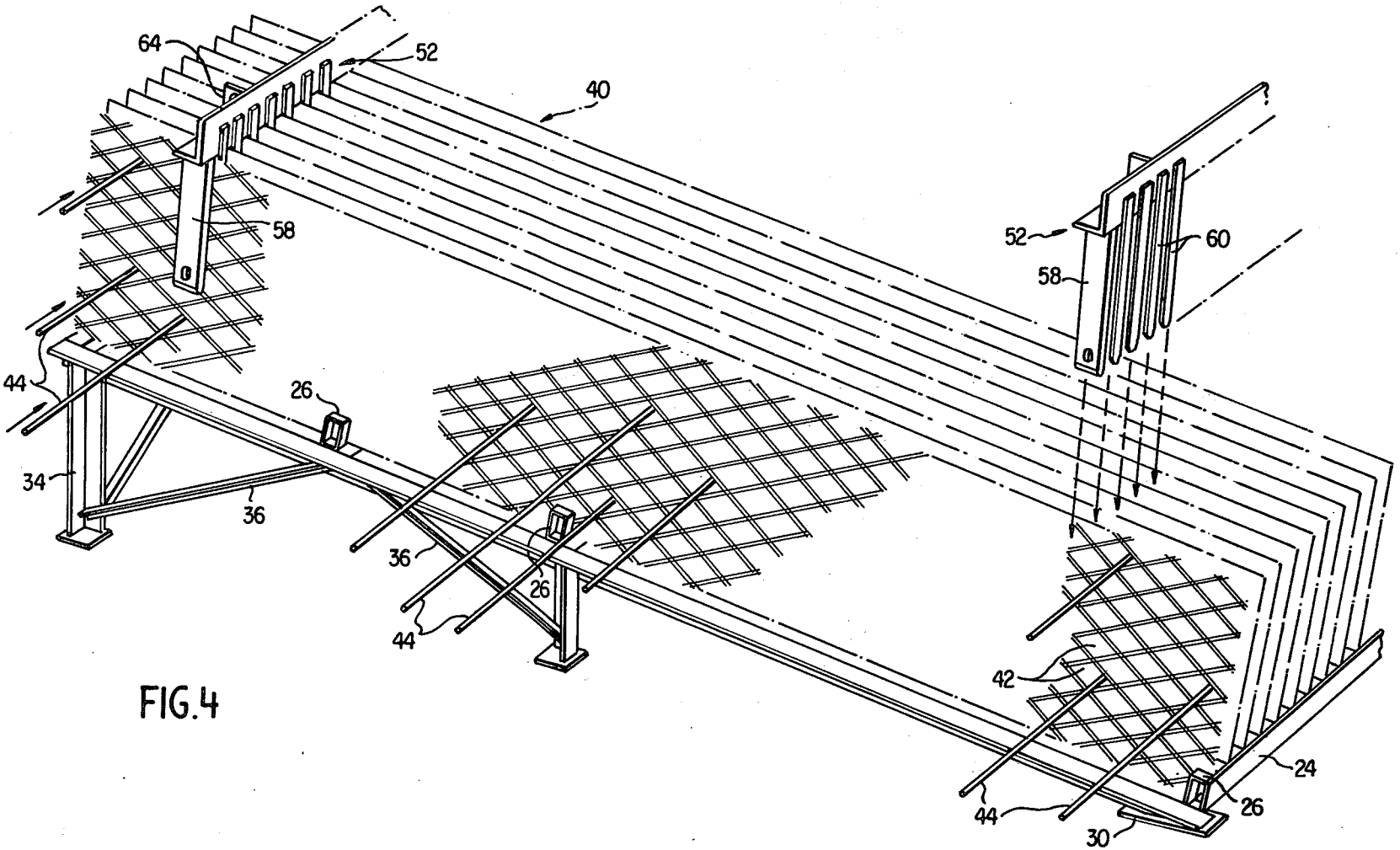
FIG. 4 is a fragmentary perspective view similar to FIG. 3 but illustrating the use of auxiliary alignment frame members to obtain vertical alignment of the expanded members.

Referring now to FIGS. 3 and 4, the assembly of a plurality of expanded metal sheet members 40 is indicated with each spacing between the lateral spacing members 26 intended to receive a single expanded metal sheet member 40. Thus each expanded metal sheet member 40 has apertures 42 through which rod members 44 may be inserted with at least some of the rod members extending beyond a composite stack of the expanded sheet members 40 as is illustrated in FIG. 4. With the rod members 44 inserted through the apertures 42 of the expanded metal sheet members 40 and with the fixture elevated by means of the legs 32 and 34, it becomes possible to tie the rod members 44 to the expanded metal sheet members 40 by means of wires 46 or the like simultaneously in a plurality of different locations thereby obtaining a solid core member.

Figures 5, 6:
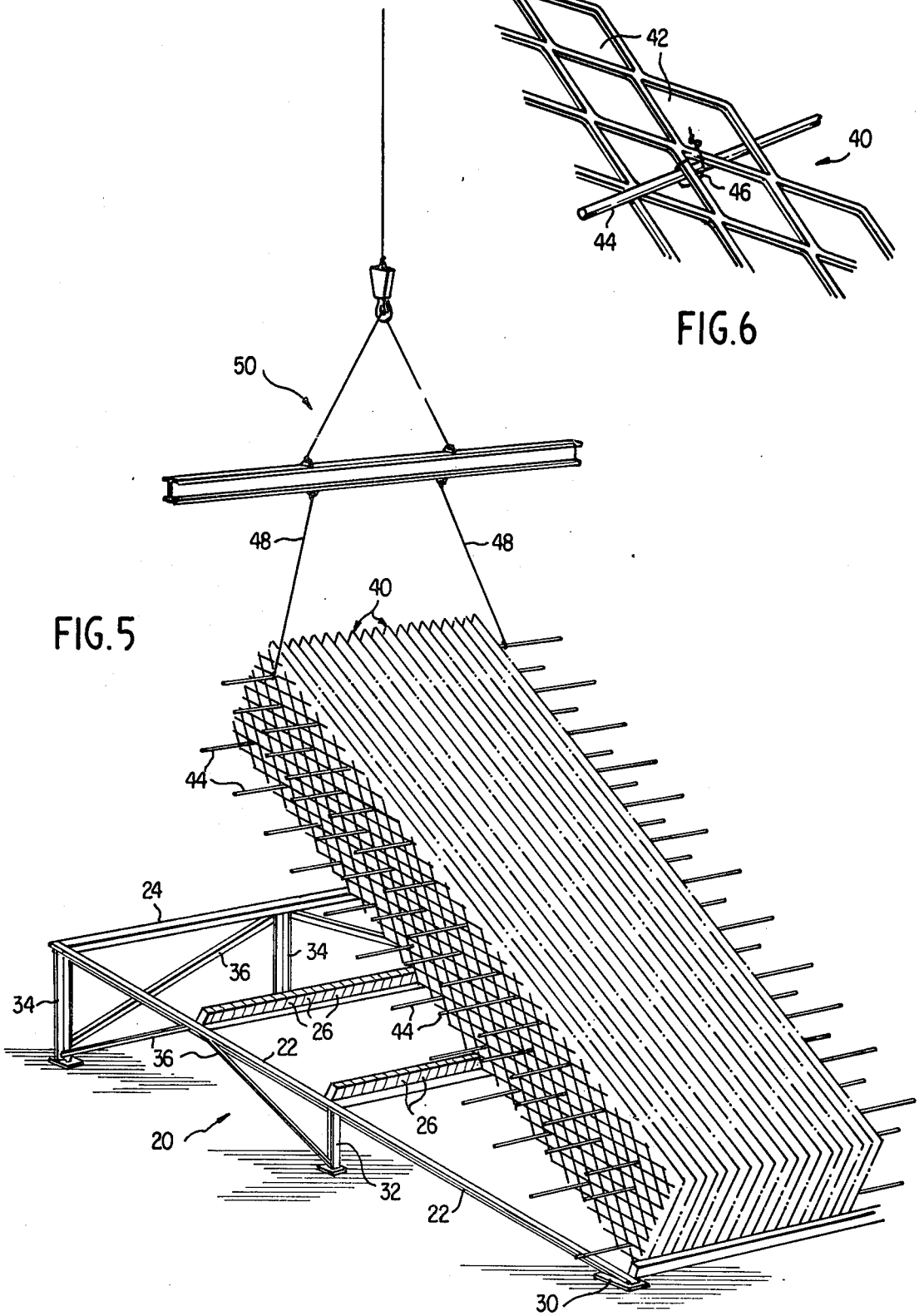
FIG. 5 is a fragmentary perspective view illustrating the removal of a pre-assembled and tied core section from the holding fixture of FIG. 1.
FIG. 6 is a fragmentary perspective view, drawn to an enlarged scale, illustrating tying an expanded metal sheet to an interior rod member.

In an actual fixture manufactured in accordance with the present invention, a fixture 20 was provided with locations for fifty expanded metal sheet members 40 in a single stack. The width of the fixture is a variable depending upon the particular application to which the impenetrable member is to be used. After the assembled stack of expanded metal sheet members has been assembled on the fixture and the rods inserted therein to establish a desired weight per foot of the composite core and with the rods 44 adequately secured to the expanded metal sheet members, it is then possible to lift the core from fixture 20 and remove it therefrom. FIG. 5 illustrates this step in the operation accomplished with the aid of cables 48 and suitable lifting means 50 such as a block and tackle or the like from the fixture 40 to a suitable location for use or storage. In the construction of impenetrable members, it is customary to assemble a plurality of core members in juxtaposed relation and secure the core members together by securing the rod members to each other from an adjacent core to establish a composite core member. Thereafter, the floor member is completed by pouring concrete over the composite core member to establish a substantially impenetrable member.

Figures 7, 8, 9, 10, 11:
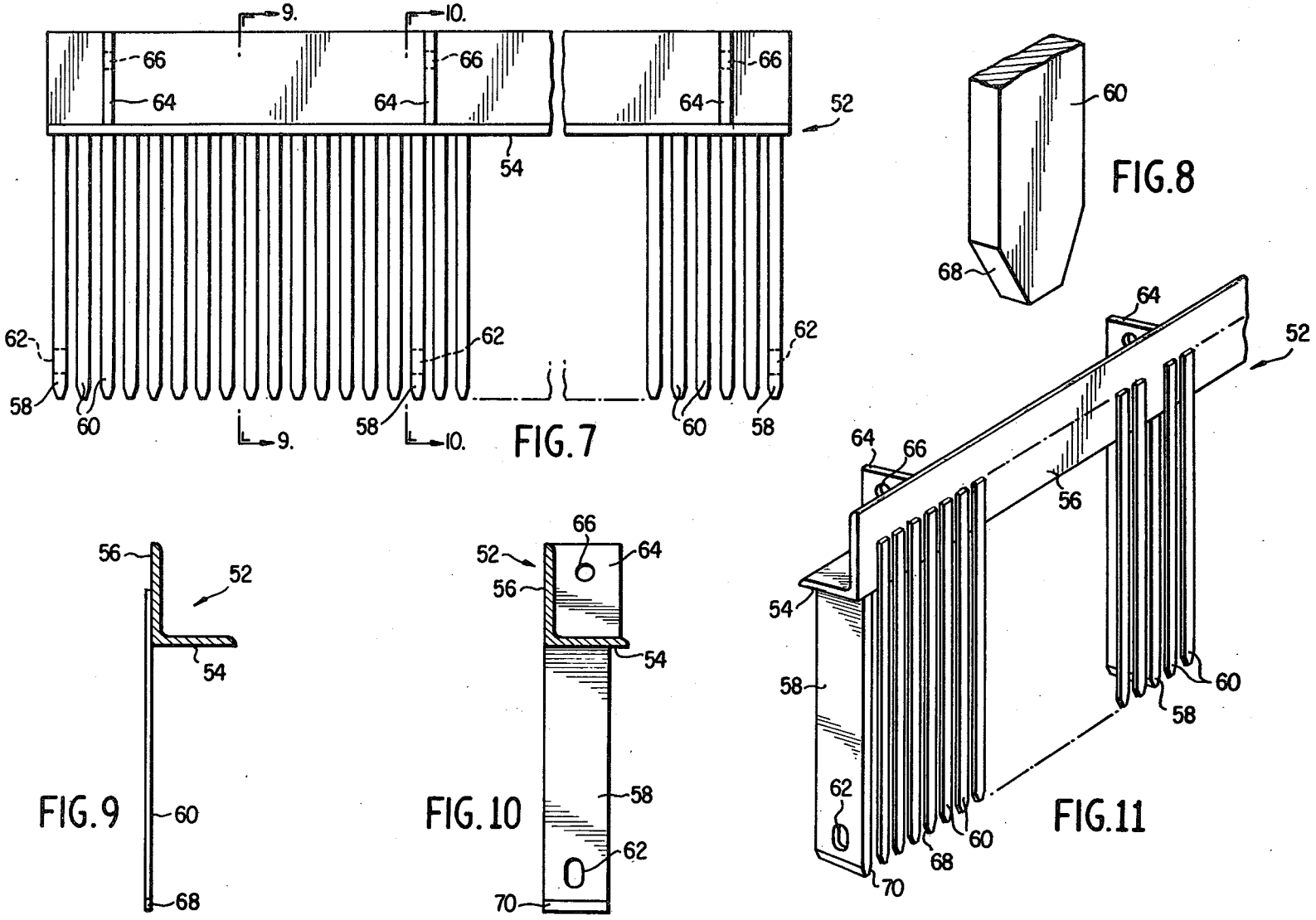
FIG. 7 is a front elevational view of one of the auxiliary alignment frame members shown in FIG. 4.
FIG. 8 is a perspective view, drawn to an enlarged scale, of one of the lateral spacing tines or teeth on the auxiliary alignment frame member of FIG. 7.
FIG. 9 is an elevational view taken in vertical cross section along line 9—9 of FIG. 7.
FIG. 10 is an elevational view taken in vertical cross section along line 10—10 of FIG. 7.
FIG. 11 is a fragmentary perspective view of the auxiliary alignment frame member of FIG. 7.

For certain impenetrable members the use of fixture 40 is adequate in and of itself to establish a satisfactory core member. However, it is sometimes desirable such as when establishing a floor member which is constructed in a horizontal plane to make sure that the expanded metal sheet members 40 are aligned vertically and do not lean in one direction or the other by virtue of a slight tolerance in the spacing between the individual components of the lateral spacing members 26. In such instances, one or more auxiliary aligning device are employed such as is illustrated in FIGS. 4 and 7 through 11. The auxiliary aligning frame member is indicated generally at 52 in these figures and comprises a main frame member which is illustrated in the form of an angle member and is supported by the top surfaces of a plurality of expanded sheet metal members which in turn are supported on the fixture 20. The main frame member of the auxiliary aligning device 52 has a bottom mounting surface 54 and a vertically extending side wall mounting surface 56. A plate member 58 is suspended from the bottom mounting surface 54 and at least some of these extend between adjacent expanded metal sheet members 40. The auxiliary aligning frame member 52 also has a plurality of comb-like teeth members 60 which are supported from the side wall mounting surface of the angle member as is shown in FIGS. 7, 9 and 11. Plate member 58 has a slotted aperture 52 which permits the insertion of a rod member therethrough while accommodating the metal grid portion of the expanded sheet metal members and which facilitates the lifting and interlocking of the auxiliary aligning frame member 52 with the spaced stack of expanded metal sheet members 40. Similarly, bracing members are employed at 64 for the angle member of the auxiliary aligning frame member 52. Each bracing member 64 is also provided with an aperture 66 to permit the insertion of a lifting rod.

FIG. 8 shows the detail of one of the comb-like tooth members 60 which has a tapered end at 68 for insertion between adjacent expanded metal sheet members 40. Similarly, the plate member 58 has a tapered end at 70.

Various changes and modifications may be made in the structure of the fixture employed in the present invention without departing from the scope of the invention. For example, instead of having an inclined frame, a substantially equivalent structure may be obtained by using fluid operated pressure means for elevating one end of the fixture frame with respect to an opposed end. Similarly, the frame can be designed to accommodate semi-circular or circular members whereby the invention may be used in connection with nuclear reactors or the like.

In the FIG. 4 embodiment, the use of a pair of auxiliary aligning frame members 52 is illustrated in connection with a single fixture 20. The number of auxiliary aligning frame members is a function of the length of the expanded metal sheet members 40 which are employed. In a typical installation, the expanded sheet metal members 40 are made from steel such as are sold under the trademark "Steelcrete" by the Wheeling Corrugating Company, a Division of Wheeling-Pittsburgh Steel Corporation of Wheeling, W. Va. The primary function of impenetrable members when used in a bank vault, for example, is to resist penetration for the longest period of time. Tests have been conducted to establish that concrete with an embedment of expanded sheet metal members stands to offer greater protection than reinforcing bars placed in a few planes of concrete. By positioning the steel sheets in walls, perpendicular to the face of the wall provides more resistance to explosions than bar grids placed parallel to wall faces.

While a presently preferred embodiment of the invention has been illustrated and described, it will be recognized that the invention may be otherwise variously embodied and practiced within the scope of the claims which follow.

I claim:

1. A fixture for use in making a core to facilitate the manufacture of substantially impenetrable members which comprises:

(a) a frame having longitudinal and lateral support members, (b) a plurality of lateral spacing members supported by the lateral support members of said frame, (1) said lateral spacing members adapted to receive a plurality of expanded metal sheet members to establish a spaced stack thereof with rod members inserted through the openings in said expanded metal sheet members at least some of which extend beyond the sides of said spaced stack thereof, (c) and means elevating one end of said longitudinal support members with respect to the other end thereof whereby said support rods may be secured to said expanded metal sheet members simultaneously in a number of different positions.

2. A fixture for use in making a core as defined in claim 1 wherein one end of said frame has a flat plate member engageable with the ground and the opposite end of said frame is elevated by means of leg members.

3. A fixture for use in making a core as defined in claim 1 wherein said lateral spacing members consist of angle members welded to each other and to said lateral support members.

4. A fixture for use in making a core as defined in claim 1 wherein said fixture is made portable by releasably bolting one contiguous longitudinal support member to another.

5. An auxiliary alignment frame member for use in combination with the fixture of claim 1 which comprises a main frame member supported by the top surfaces of a plurality of expanded sheet metal members supported in said fixture, a plurality of comb-like teeth members each insertable into an opening between adjacent expanded sheet metal members and means to lock said auxiliary alignment frame member to said expanded sheet metal members.

6. An auxiliary alignment frame member as defined in claim 5 wherein said means to lock said auxiliary alignment frame member to said expanded sheet metal members includes a plurality of plate members secured to the underside of said main frame member insertable between said expanded sheet metal members and provided with an aperture to receive a locking rod member insertable transversely of said expanded sheet metal members.

7. An auxiliary alignment frame member as defined in claim 5 wherein said auxiliary frame member is provided with a series of bracing members supported by and attached to said main frame member above said expanded sheet members with said bracing members provided with means for lifting said auxiliary frame member.

8. In an aligning device for use in connection with the manufacture of a core for a substantially impenetrable member, the construction which comprises:

(a) a main carrier member having bottom and sidewall mounting surfaces, (b) a first plurality of plate members suspended from a bottom mounting surface of said main carrier member at least some of which are intended to be inserted between a plurality of expanded sheet metal members to effect lateral spacing thereof, (c) a second plurality of comb-like teeth members supported from a sidewall mounting surface of said main carrier member, (d) and means to lock said aligning device to said expanded sheet metal members.

9. In an aligning device as defined in claim 8 wherein some of said expanded sheet metal members are spaced laterally by the width of said comb-like teeth members.

10. In an aligning device as defined in claim 8 wherein each of said plurality of plate members is provided with an aperture to receive a locking rod member insertable transversely of said expanded sheet metal members.

11. In an alignment device as defined in claim 8 wherein said main carrier member constitutes an angle member and is provided with a series of bracing members between the legs thereof with said bracing members provided with means for lifting said angle member.

* * * * *